United States Patent [19]

Harris et al.

[11] 4,433,242

[45] Feb. 21, 1984

[54] ESR HOLLOWS MOLTEN METAL/SLAG INTERFACE DETECTION

[75] Inventors: Bernard Harris, Chelmsford, Mass.; Howard J. Klein, Kokomo, Ind.

[73] Assignee: Cabot Corporation, Boston, Mass.

[21] Appl. No.: 294,536

[22] Filed: Aug. 20, 1981

[51] Int. Cl.[3] ..... G01N 23/00; G01T 1/20

[52] U.S. Cl. ..... 250/358.1; 250/363 R; 378/52

[58] Field of Search ..... 250/252, 357.1, 358.1, 250/361 R, 363 R; 378/52, 57

[56] References Cited

U.S. PATENT DOCUMENTS 3,590,777 7/1971 Elam et al. ..... 378/52

3,668,386 6/1972 Blecherman et al. ..... 378/52

*Primary Examiner*—Janice A. Howell

*Attorney, Agent, or Firm*—Jack Schuman; Joseph J. Phillips; Barry R. Blaker

[57] ABSTRACT

An improved system for detecting the location of a molten metal/slag interface during the casting of electroslag remelted hollows is provided. The system includes a gamma ray radiation source (30) and a scintillation counter (40). The source (30) and counter (40) reside outside the casting crucible (1) and are held in fixed spatial relationships with respect to one another and with respect to the mandrel (10). The radiation from the source (30) is directed through the crucible (1) and through the annular casting zone (9) defined between the sidewalls of the upwardly driven mandrel (10) and the crucible (1). The counter (40) provides an electrical signal responsive to the rate of radiation events detected thereby.

16 Claims, 2 Drawing Figures

ESR HOLLOWS MOLTEN METAL/SLAG INTERFACE DETECTION

FIELD OF THE INVENTION AND PRIOR ART

The present invention relates generally to electroslag remelting (ESR) and is more precisely concerned with method and means for detecting the relative position of a molten metal/slag interface with respect to an advancing mandrel in the electroslag remelt casting of hollow ingots.

Electroslag remelting of metals, particularly superalloys such as cobalt- and nickel-based superalloys, has gained substantial commercial and technical acceptance. Broadly, electroslag remelting entails resistance melting of a consumable metal electrode, the melting end of which electrode is immersed in a flux layer overlying the molten metal pool beneath. An externally cooled elongate casting crucible is employed to receive and define the exterior surface of the cast metal as it is produced as well as to confine the flux layer thereover. As an electroslag remelting run progresses the level of the molten metal/slag interface within the casting crucible rises, leaving behind it the solidified cast metal product. The melting end of the consumable electrode is maintained in spaced relationship with respect to the surface of the molten metal pool, the flux layer interposed therebetween acting as an electrically resistive element in the current path. The flux layer also acts as a thermal insulator, a physical barrier between the molten metal and ambient atmosphere and as a scavenging agent for the impurities released from the electrode as it melts. Thus, the electrode, flux and molten metal interact physically, electrically and chemically during the remelting operation to yield a refined cast metal product.

Desirably, the shape of the cast electroslag remelted product is such as to minimize the number and extent of the machining and forming operations thereafter required to manufacture finished products. Thus, in many instances, casting of electroslag remelted solid ingots of appropriate dimensions and exterior geometries will suffice to meet this need. Obviously, however, there exist many finished wares of interest, such as tubular and disk-shaped products, which comprise hollow cores. To be required to machine, drill, ream, forge or otherwise form solid ingots into finished hollow wares generally constitutes an undesirably labor-intensive practice which also often results in undue production of scrap. To this end, therefore, the electroslag remelting process broadly described above has been modified to permit casting of hollow ingots from which preparation of finished hollow or tubular wares is more readily and quickly accomplished with minimum scrap production. Said modification comprises the employment of an internally cooled mandrel of suitable dimensions positioned centrally within the crucible. The mandrel is driven upwardly from the bottom of the crucible as the consumable electrode is melted and the crucible filled. Accordingly, the space between the centrally located mandrel and the confining walls of the crucible defines an annular casting zone. In so-called "ESR hollows" production, the mandrel is advanced upwardly at a rate such that solidification of the molten metal adjacent thereto occurs as the mandrel passes therethrough. This means that the tip of the advancing mandrel is required to be positioned at or slightly above the molten metal/slag interface. The rate at which the consumable electrode is fed downwardly towards the upwardly moving mandrel tip is controlled to maintain the spacing between the mandrel and electrode tips substantially constant.

In order that the aforedescribed ESR hollows process may be carried out successfully it is vital that the molten metal/slag interface rising within the crucible be maintained at a fixed position relative to the position of the upwardly advancing mandrel. The rate at which the molten metal/slag interface level rises is dictated by the rate at which the consumable electrode is melted. Said melting rate, in turn, is controlled primarily by the current flow through the resistance circuit established between the power supply, electrode, flux and molten metal. Should the molten metal/slag interface level advance excessively upwardly of the mandrel the molten metal existing above the mandrel tip can solidify prematurely, thereby resulting in so-called "freeze-up" of the mandrel. On the other hand, if the molten metal/slag level is allowed to recede excessively relative to the mandrel, a condition termed "run-out" can occur whereby the molten metal and flux falls uncontrollably through the core of the annular solidified cast metal standing below the advancing mandrel.

In ESR hollows processes of the prior art the detection of the position of the molten metal/slag interface relative to the mandrel is conventionally undertaken by means of a combination comprising a gamma radiation source positioned outside the casting crucible and an ionization chamber located within the mandrel. The gamma radiation source beam is projected directly across the annular casting zone towards the mandrel-enclosed ionization chamber and is held in a fixed position relative thereto. Accordingly, the gamma radiation source remains in a fixed location with respect to the mandrel as the latter is driven upwardly within the crucible.

Several disadvantages accrue to the molten metal/slag detection system outlined above. Firstly, substantial apparatus complexity is involved in the design and construction of an internally cooled mandrel housing the ionization chamber component and the signal output leads thereof. Secondly, access to the ionziation chamber for servicing, calibration and the like obviously requires disassembly of the mandrel. Thirdly, since the space not dedicated to cooling within the mandrel is physically limited, it is usually not possible to equip the ionization chamber with sufficient shielding as to minimize detection of radiation backscattering. Thus, the signal-to-noise ratios experienced with such systems are not normally conducive to exquisite accuracy of molten metal/slag interface detection, a maximum sensitivity of about $\pm 0.25$ inch (0.00635m) being typical. Additionally, it is not uncommon during ESR hollows operations for the mandrel to depart substantially from the longitudinal centerline of the crucible. Under these conditions, and where the ionization chamber element of the molten metal/slag interface detection system is located within the mandrel, there result changes in radiation path length, as well as certain losses of collimation of the ionization chamber with respect to the radiation source. Radiation intensity sensed by the ionization chamber varies inversely as the square of the length of the radiation path. Therefore, relatively small changes in radiation path length caused by off-axis operation of the mandrel can cause substantial changes in the radiation sensed by the mandrel-housed ionization chamber and can result in false interpretation of the molten metal/slag interface position. Loss of ionization chamber/source collimation, of course, can also lead to loss of detection sensitivity and false interpretation of the data. In accordance with the present invention, however, these and other problems associated with gamma ray detection of the molten metal/slag interface in ESR hollows operations are either eliminated or substantially ameliorated.

It is a principal object of the present invention to provide a novel molten metal/slag interface detection system in association with an electroslag remelting furnace for the production of hollow ingots.

It is another object of the present invention to provide a novel method for detecting the level of the molten metal/slag interface in the production of hollow ingots by the method of electroslag remelting.

Other objects and advantages of the present invention will, in part, be obvious and will, in part appear hereinafter.

SUMMARY OF THE INVENTION

The detection system of the invention is associated with an electroslag remelting crucible equipped with a mandrel adapted for upward movement therein and means for feeding a consumable electrode downwardly into the crucible. An annular casting zone is defined between the interior sidewall of the crucible and the exterior sidewall of the mandrel throughout the length of the upward translation of the mandrel. The detection system of the invention comprises a gamma radiation source and a scintillation counter, both elements being located exterior of the electroslag remelting crucible and both elements being held in spatially fixed positions relative to the mandrel and to one another. The gamma radiation source is positioned such as to project source radiation through the annular casting zone along a radiation path which avoids direct contact thereof with the mandrel. The scintillation counter detector is positioned at the opposite end of the thusly defined radiation path so as to detect that radiation which penetrates through the walls of the crucible. Desirably, the gamma radiation source and scintillation counter are each shielded and are collimated so as to reduce backscatter generation and detection.

THE DRAWING

FIG. 1 hereof is a schematic, diagrammatic, partially sectional, side view of an ESR hollows furnace during the course of a remelting program, said furnace being equipped with a molten metal/slag interface detection system in accordance with the invention. Also shown, in block diagram form, is a typical resistance circuit employed to melt the consumable electrode and, in addition, an electronics block diagram disclosing suitable signal processing circuitry for the scintillation counter radiation detection element of the system.

FIG. 2 hereof is a schematic diagrammatic sectional top view of the ESR hollows furnace of FIG. 1 taken through line 2—2' thereof.

DESCRIPTION OF PREFERRED EMBODIMENTS

Figure 1:
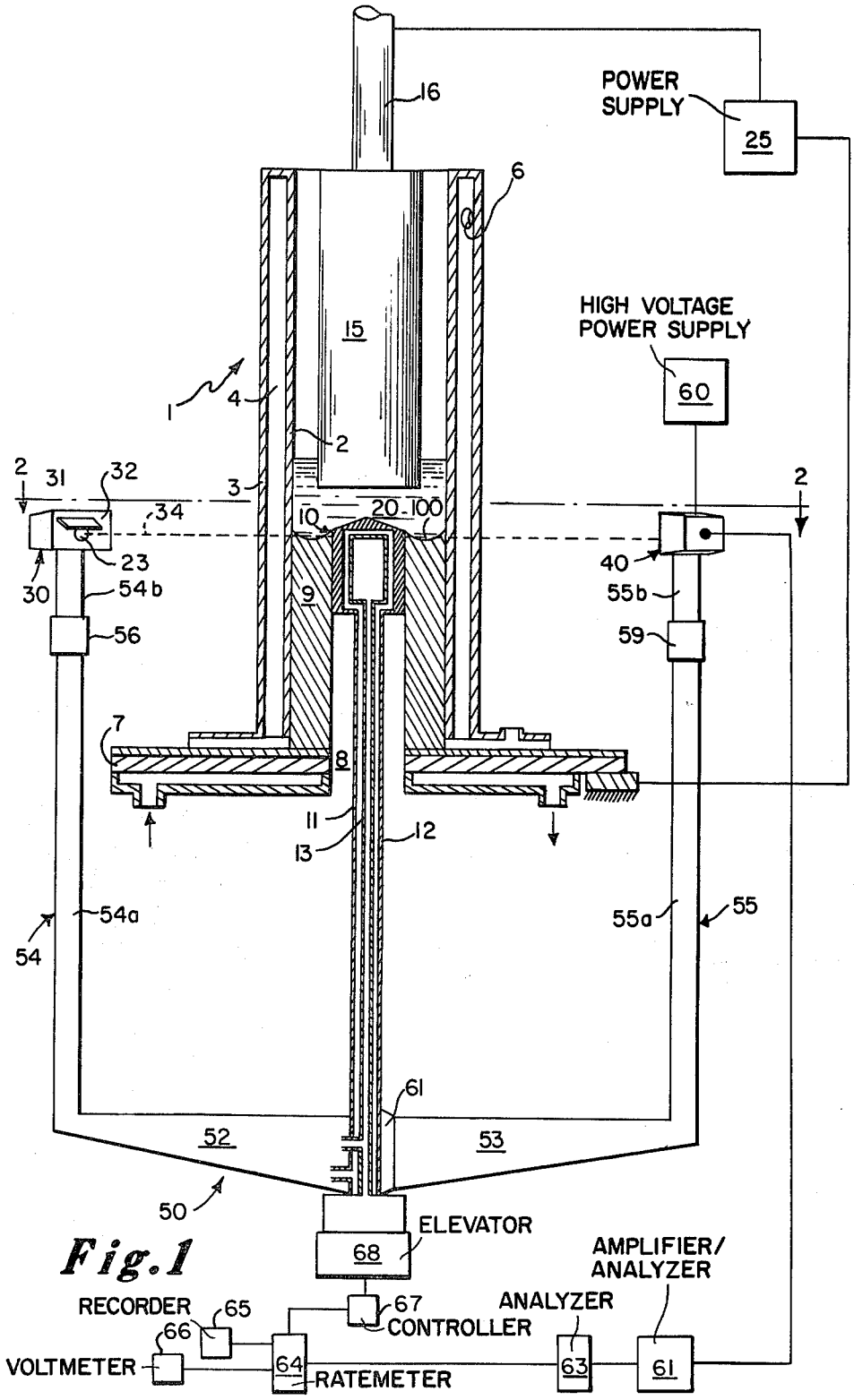

Preferring now to the drawing, wherein like reference numerals refer to like structures, the ESR hollows furnace broadly comprises an electoslag remelting crucible 1 containing therein a mandrel 10 and a consumable electrode 15. The crucible 1 comprises an interior casting sidewall 2, usually composed of a metal having good heat conductivity, such as copper, and which wall 2 is surrounded by a spaced apart cooling jacket 3 so as to define a coolant flow chamber 4 therebetween. A coolant, such as water, is introduced into flow chamber 4 through inlet 5 and is exited through outlet 6. The bottom of the crucible 1 is defined by a separate, externally cooled stool 7 having a central aperture 8 of a size and geometry adapted to receive the mandrel 10 in close-fitting relationship therethrough. At startup of an electroslag remelting program the mandrel 10 is positioned within the aperture 8, thereby to form a closure for the bottom of the crucible 1.

Mandrel 10, which is hollow, is adapted for upward, substantially coaxial movement within the crucible 1 by means of a tubular thrust member 11 affixed to the bottom thereof and which member 11 contains a concentrically positioned coolant supply pipe 12 therein. Coolant is introduced into mandrel 10 through the supply pipe 12 and is exhausted through the annular space 13 defined between supply pipe 12 and tubular thrust member 11. The lower end of the tubular thrust member is affixed to a suitable elevator mechanism 68 therefor which is typically of the hydraulic type.

Consumable metal electrode 15 is suspended substantially coaxially in the crucible 1 and is carried by suspension member 16, the electrode 15 usually being affixed to one end of said suspension member 16 by being originally cast tightly thereabout. The other end of suspension member 16 is affixed to a suitable elevator device (not shown) which is adapted to controllably raise and lower the electrode 15 into the crucible 1.

At startup of an electroslag remelting operation the mandrel 10 is, as mentioned previously, stationed within the aperture 8 of stool 7, thereby to form a bottom closure of the crucible 1. A preselected charge of a suitable flux 20 is fed to the crucible and the consumable electrode 15 lowered into the flux to a selected spacing between the lower end thereof and the upper end of the mandrel 10. The stool 7 forms a common ground with the ground lead of power supply 25, which supply generally is of the type which provides an alternating current output. The hot lead of the power supply 25 is electrically connected to consumable electrode 15 through suspension arm 16, thus completing the resistance melting circuit of the system wherein the flux layer 20 acts as the principal resistance element. The current (or amperage) of the power supply 25 is controlled such as by controller 24, thereby to control the melting rate of the electrode 15. As the electrode 15 melts the impurities forming part thereof are scavenged by the flux 20 and the purified molten metal collects in the annular casting space 9 defined between the sidewall of mandrel 10 and the sidewall 2 of the crucible 1. Said molten metal is cooled to solidification through the agency of heat extraction by the coolant flowing through mandrel 10, coolant chamber 4 and the stool 7. The mandrel 10 is forced upwardly through the solidifying molten metal while the spacing between the mandrel tip and the electrode is maintained by suitable control of the electrode feed rate into the crucible 1. Upon onset of the melting of the electrode 15, there is formed a molten metal/slag interface 100 which, of course, rises in the crucible 1 as the melting of electrode 15 proceeds. It is vital to successful operations that the mandrel 10 be forced upwardly into the crucible 1 at a rate such that the molten metal/slag interface 100 be held at a substantially fixed level with respect to the mandrel 10 position.

Should the upward speed of the mandrel be excessive, it can be forced through the molten metal into the flux 20, thereby ultimately allowing the molten metal (and the flux) to flow behind the mandrel and into the core space of the trailing solidified annular cast metal product and through aperture 8. This run-out not only stops a run due to the loss of the flux resistance element, but it usually also entails substantial downtime for repair and cleanup of the elevator mechanism 58 for thrust member 11 and associated hoses and electrical cables due to contact and burning thereof by the escaped molten metal and flux. On the other hand, should the upward advance of mandrel 10 be excessively slow, the molten metal/slag interface 100 can rise above the mandrel 10 and give rise to the danger that the molten metal will cool excessively prior to penetration by the mandrel 10 and will solidify or partially solidify prior to the forming thereof by the mandrel. Where excessive, this lagging of the mandrel 10 behind the molten metal/slag interface 100 can generate a freeze-up condition. Simply put, the force required to carry the mandrel 10 through the solidifying molten metal becomes excessive, the mandrel 10 rate usually slows further and, ultimately, the mandrel becomes entrapped in the solidifying metal. This, of course, causes great difficulties since removal of the mandrel and ingot together from the crucible 1 is usually arduous and since the necessary jackhammering and the like normally required to remove the mandrel from the frozen ingot generally results in destruction of the mandrel 10 to the point that it cannot be reused and causes destruction of at least a portion of the partially formed hollow ingot.

Thus, it is clear that continuous precise knowledge of the level of the molten metal/slag interface 100 relative to the mandrel 10 is necessary to avoid the aforementioned operational catastrophies and in order to provide the operator with a sufficiency of data to effectively control the process. Generally speaking, it is necessary that the level of the molten metal/slag interface be detectable to at least within about ±0.25 inch (0.00635 m) relative to the mandrel 10 position. By the present invention, detection of change of the level of the molten metal/slag interface 100 relative to mandrel 10 position of as little as ±0.0625 inch (0.00156 m) can be made.

Unlike prior art ESR hollows gamma radiation molten metal/slag interface detection systems known to the present applicants, the detector element in the present invention is not located within the mandrel 10. Rather it is located outside the crucible 1. Moreover, the gamma radiation source is positioned in such manner that the primary radiation path thereof traverses, seriatim: (a) the walls of crucible 1, (b) the annular cross-section of the casting zone and (c) the walls of crucible 1, all absent direct contact thereof with the mandrel 10. It should be noted and understood that the mandrel 10 and interior casting sidewall 2 of the electroslag melting furnace can be of substantially any geometry required to produce hollow ingots of the desired interior and exterior cross sectional geometries, such as squares, rectangles, circles or any combination thereof. However, in the following specific exemplary description and in the drawing, the mandrel 10 and interior casting sidewall 2 of crucible 1 are each of circular cross-section. Since ESR hollow ingots bearing the combination of circular interior and exterior cross-sections are presently of substantial commercial popularity this combination of mandrel and crucible geometries represents a preferred, but not necessary, embodiment of the invention, the underlying principles of the invention being applicable to other specific crucible and mandrel geometries.

From FIG. 1 it will be seen that the molten metal/slag interface detection system of the invention broadly comprises a gamma radiation source 30, scintillation counter 40 and means 50 to affix the source 30 and counter 40 in fixed mechanical relationships with respect to mandrel 10 and to one another.

Gamma radiation source 30 comprises a shielded enclosure 31 which houses source material such as Cesium 137 or Cobalt 60. The enclosure 31 is equipped with a shutter, shown schematically at 32, which is operable to open and shut on command, thereby to allow the source radiation to escape through aperture 33 as beam 34 or to wholly contain said radiation within the enclosure 31. Desirably, the aperture 33 is suitably shielded such as to collimate the source radiation into a narrow beam.

Scintillation counter 40 employs as the detecting element thereof a radiation responsive crystal element, such as cadmium tungstate, calcium tungstate or sodium iodide, which element is excited to produce emitted light impulses in response to $\gamma$-radiation events sensed thereby. These light impulses are, in turn, sensed by a photomultiplier which amplifies the signal and converts same into a measurable electrical signal. A preferred crystal sensing element in the practice of the invention comprises thallium-doped sodium iodide. In another preferred embodiment of the system of the invention the crystal sensing element of counter 40 is shielded and collimated with respect to the radiation beam 34 such that sensing of $\gamma$-radiation backscatter is minimized. In yet another preferred embodiment of the invention the sensing crystal element also comprises an internal reference radiation standard, such as Americium-241, in order that the sensed radiation from radiation source 30 may be gain-stabilized by continual or periodic electronic comparison of the detected source beam against said internal reference standard. Scintillation counters, including those bearing the above-preferred features, are well-known and require no further detailed elaboration herein.

The gamma radiation source 30 and counter 40 are each held in fixed spatial relationship with respect to the mandrel 10 and to one another by means 50. Said means 50 can take the form of, for instance, a yoke member 51, the center of which is affixed to tubular thrust element 11 and is laterally displaced from the longitudinal centerline thereof by means of lateral arm 61. Extending laterally from the center of yoke member 51 are yoke arms 52 and 53, respectively, the ends of which arms are each disposed beyond the perimeter of the crucible stool 7, thereby to provide sufficient clearance of the detection apparatus of the invention as to allow use of the largest crucibles for which the stool 7 is designed. Rigidly affixed to the ends of the arms 52 and 53 are vertical support members 54 and 55, respectively, which members are each of sufficient length as to position the gamma radiation source 30 or radiation detector 40, as the case may be, at the selected level with respect to the mandrel 10. Desirably, support arms 54 and 55 are each provided with means 56 and 57, respectively, for adjustment of the length thereof. Said means 56 and 57 can take the form, for instance, of a threaded collet into which the upper arm sections 54(*b*) and 55(*b*) can be independently threaded and longitudinally adjusted with respect to lower arms sections 54(*a*) and 55(*a*), respectively, as needed to provide independent height adjustments of radiation source 30 and counter 40 with respect to one another and with respect to the mandrel 10. As can be seen from the foregoing arrangement, upon such independent adjustments of the lengths of vertical support members 54 and 55 relative to the mandrel 10 and relative to one another, the spatial relationships of mandrel 10, counter 40 and radiation source 30 are fixed and thereafter remain essentially invariant as the mandrel 10 is thrust upwardly through the crucible 1 during the course of a remelting operation.

Figure 2:
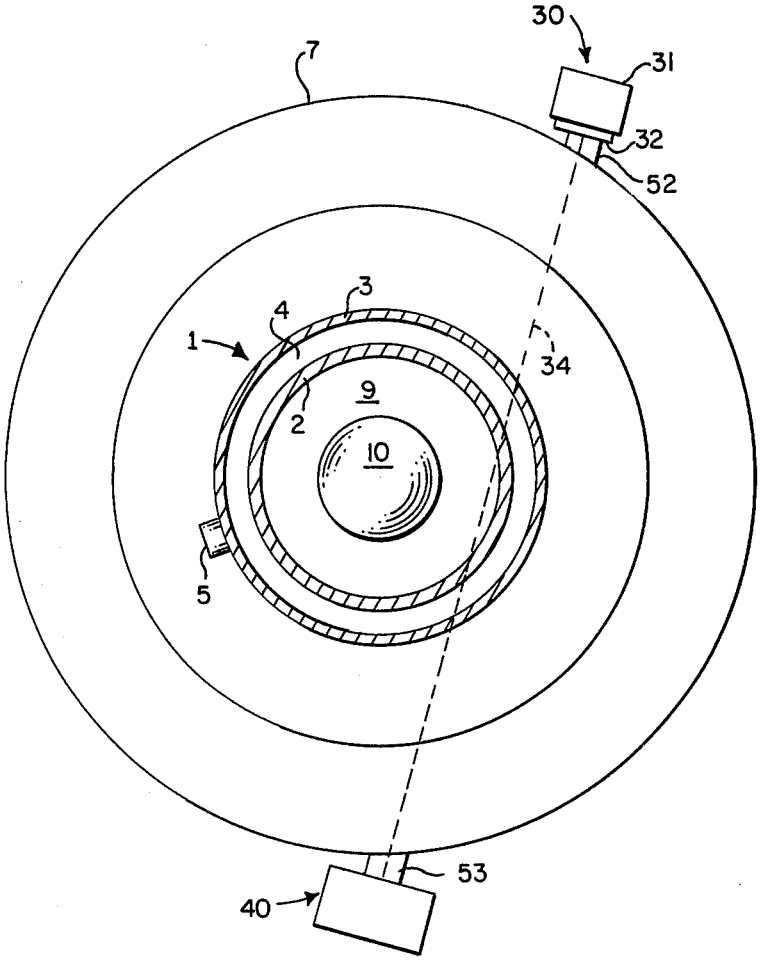

As can probably be seen most clearly by reference to FIG. 2, an essential characteristic of the system of the present invention resides in the off-axis path taken by the radiation beam 34. Said path courses through the annular casting zone 9 defined between the exterior sidewall surface of mandrel 10 and the interior surface of casting sidewall 2 of crucible 1 and avoids direct contact of the beam (other than that due to backscatter) with the mandrel 10. While it would intuitively seem that maximum molten metal/slag level detection sensitivity of the system of the invention is attained when the radiation beam 34 is adjusted to traverse the maximum possible path length within annular casting zone 9, such is surprisingly not the case. Where the exterior perimeter of the casting zone is defined by a circular casting sidewall 2, the combined benefits of maximum molten metal/slag level detection sensitivity and minimum required source strength are realized when the chord angle $\theta$, of the radiation beam 34 is selected to maximize the numerical value of the expression $I/\epsilon A$ in EQUATION 1.

EQUATION 1

$$\frac{I}{\epsilon A} = \frac{3.2 \times 10^7 n}{\cos^2\theta} \exp - [2\mu_1\rho_1(1452 - 2304 \sin^2\theta)^{\frac{1}{2}} + 2\bar{\rho}\bar{\mu}(48 \cos\theta - (1452 - 2304 \sin^2\theta)^{\frac{1}{2}})]$$

wherein: $\bar{\rho}$ is the weighted average crucible 1 density (g/cm$^3$); $\bar{\mu}$ is the weighted average mass absorption coefficient (cm$^2$/g); I is the detected radiation intensity (number of counts per second); $\epsilon$ is the detection efficiency of the counter 40 (decimal quotient of the number of radiation counts per second detected by counter 40 divided by the actual number of radiation counts per second reaching the crystal element of said counter 40); A is the surface area of the crystal sensing element employed in said counter 40 (cm$^2$); n is the source strength of the gamma radiation source material (Curies) and $\theta$ is the included angle defined between an imaginary leg drawn between the longitudinal axes of the radiation source 30 and mandrel 10 and the leg defined by the actual path of radiation beam 34.

The weighted average crucible 1 density, $\bar{\rho}$, may be determined in accordance with EQUATION 2.

EQUATION 2

$$\bar{\rho} = \frac{\rho_3 X_3 + \rho_4 X_4}{X_3 + X_4}$$

wherein $\rho_3$ is the density of the metal employed in the construction of crucible 1 (g/cm$^3$); $\rho_4$ is the density of the coolant fluid employed to cool the crucible 1 (g/cm$^3$); $X_3$ is the total path length, through metal, traversed by the radiation beam 34 (cm); $X_4$ is the total path length, through coolant fluid, traversed by the radiation beam 34 (cm).

The weighted average mass absorption coefficient, $\bar{\mu}$, may be determined in accordance with EQUATION 3.

EQUATION 3

$$\bar{\mu} = \frac{\mu_3 X_3 + \mu_4 X_4}{X_3 + X_4}$$

wherein $\mu_3$ and $\mu_4$ are the mass absorption coefficients of the metal of crucible 1 and fluid coolant, respectively (cm$^2$/g).

In visual terms, EQUATION 1 above indicates that maximum transmission of the energy of the radiation beam 34 to the detection element of counter 40 occurs in the practice of the present invention when the radiation beam 34 just grazes the interior surface of the circular sidewall 2 of the crucible 1.

Utilizing the preferred embodiment of counter 40 comprising a detection crystal doped with a reference $\gamma$-radiation material, suitable signal processing electronics for the system of the invention is shown in schematic block diagram form in FIG. 1 hereof. The scintillation counter 40 is supplied with high voltage power by means of high voltage power supply 60. The photomultiplier electrical signal output of counter 40 is injected into a stabilized amplifier/single channel analyzer 61, said analyzer 61 locking on the reference dopant energy peaks sensed by the crystal for stabilized operations. The thusly gain-stabilized linear output signal of amplifier/analyzer 61 is then conducted to a single channel analyzer 62 wherein summation of $(E+\Delta E)$ is performed electronically. This signal is then injected into ratemeter 64 which counts the $\gamma$-ray events sensed by the counter 40 and provides a suitable electrical signal for injection into a data storage and/or viewing device such as a strip chart recorder 65 or voltmeter 66. Under those conditions wherein the molten metal/slag interface 100 rises relative to the preselected datum plane, the radiation beam 34 is intercepted by a relatively greater proportion of molten metal, thereby substantially attenuating the energy of the beam sensed by the counter 40. Thus, the sensed count rate lessens, is displayed by the recorder 65 or voltmeter 66 and thereby warns the ESR operator of the rise of the molten metal/slag interface relative to the preselected datum plane. On the other hand, where the molten metal slag/interface 100 lags behind the preselected datum plane, the radiation beam 34 is intercepted by a greater proportion of flux and a lesser proportion of the molten metal. Since the flux attenuates the radiation beam 34 to a far lesser extent than the molten metal, there occurs a substantial rise in the event rate sensed by the counter 40. This condition is also displayed by the recorder 65 or voltmeter 66, thereby warning the ESR operator of the lagging of the interface 100 relative to the upward translation of mandrel 10 and allowing the operator to compensatorily slow the speed of said mandrel 10 and/or increase the melting rate of electrode 15. If desired, the ratemeter 64 can be coupled to a controller 67 for elevator mechanism 68, thereby achieving a substantial degree of automatic control of the ESR hollows operation.

What is claimed is:

1. In an ESR hollows furnace comprising a crucible; a mandrel located substantially coaxially within said crucible, said mandrel being upwardly driven to define a progressive annular casting zone between said mandrel and said crucible; and means to deliver a consumable metallic electrode into said crucible and to maintain a substantially constant spacing between the upper end of said mandrel and the lower end of said electrode, the improvement which comprises: a molten metal slag interface detection system comprising a gamma radiation source and a scintillation counter, said source and said counter each being stationed exterior said crucible, means to maintain said source and said counter in fixed spatial relationships with respect to said mandrel and to one another, said source being oriented to direct a gamma radiation beam therefrom along a radiation path which traverses said annular casting zone without direct contact of said beam with said mandrel, said counter being oriented to sense said source radiation beam upon traversal thereof through said annular casting zone and said crucible and said counter being operative to produce a detectable electrical signal responsive to said sensed beam.

2. The improvement of claim 1 wherein said radiation source includes shutter means.

3. The improvement of claim 1 wherein said radiation source comprises Cobalt-60.

4. The improment of claim 1 wherein the interior casting surface of said crucible is of circular cross-sectional geometry.

5. The improvement of claim 4 wherein the chordal angle, $\theta$, of the source beam radiation path is selected to maximize the numerical value of the expression $I/\epsilon A$ in the equation:

$$\frac{I}{\epsilon A} = \frac{3.2 \times 10^7 n}{\cos^2\theta} \exp - [2\mu_1\rho_1(1452 - 2304 \sin^2\theta)^{\frac{1}{2}} + 2\bar{\rho}\bar{\mu}(48 \cos\theta - (1452 - 2304 \sin^2\theta)^{\frac{1}{2}})]$$

wherein: $\bar{\rho}$ is the weighted average crucible density (g/cm$^3$); $\bar{\mu}$ is the weighted average mass absorption coefficient (cm$^2$/g); I is the detected radiation intensity (number of counts per second); $\epsilon$ is the detection efficiency of said counter (decimal quotient of the number of radiation counts per second detected by said counter divided by the actual number of radiation counts per second reaching the crystal element thereof); A is the surface area of the crystal sensing element employed in said counter (cm$^2$); n is the source strength of the gamma radiation source material (Curies) and $\theta$ is the included angle defined between an imaginary leg drawn between the longitudinal axes of said radiation source and said mandrel and the leg defined by the actual path of said radiation beam.

6. The improvement of claim 1 wherein the interior casting surface of said crucible and the exterior sidewall surface of said mandrel are each of circular cross-sectional geometry.

7. The improvement of claim 1 wherein said source and said counter are each shielded and collimated with respect to one another so as to minimize generation and detection of radiation backscatter.

8. The improvement of claim 1 wherein the sensing element of said counter comprises a reference radiation standard and wherein the electronic circuitry associated with said counter is operative to compare the radiation energy of said standard against the sensed radiation energy of the source beam, thereby to gain-stabilize said electrical signal.

9. The improvement of claim 8 wherein said reference standard is Americium-241.

10. The improvement of claim 1 wherein the detection element of said scintillation counter comprises thallium-doped iodide.

11. In a process for the production of ESR hollows which comprises providing an externally cooled casting crucible equipped with a coaxially located, internally cooled mandrel, said mandrel being upwardly driven along the longitudinal axis of said crucible; introducing a charge of electrically resistive flux into the crucible; lowering a consumable metal electrode into said flux charge to a spaced distance from said mandrel; establishing a resistive electrical circuit to melt the flux-immersed end of said electrode; and, as said electrode melts, driving said mandrel upwardly through the resulting cooling continuously forming molten metal pool while maintaining said spaced distance between said mandrel and the flux-immersed end of said electrode, the rate of said upward driving of said mandrel being controlled to maintain a substantially constant relative position of said mandrel with respect to the molten metal/slag interface, the improvement which comprises: detecting the location of said molten metal/slag interface relative to the mandrel by providing a gamma radiation source and a scintillation counter outside said crucible; maintaining said source and said counter in substantially fixed spatial relationships with respect to one another and with respect to said mandrel; directing a radiation beam from said source along a radiation path which traverses the annular casting zone defined between the sidewalls of said mandrel and said crucible and which avoids direct contact of said beam with said mandrel; sensing the count rate of the source radiation which traverses the annular casting zone and crucible and generating an electrical signal responsive thereto.

12. The improved method of claim 11 wherein said sidewall of said crucible is circular and wherein said radiation beam is directed along a radiation path having a chordal angle, $\theta$, selected to maximize the numerical value of the expression $I/\epsilon A$ in the equation:

$$\frac{I}{\epsilon A} = \frac{3.2 \times 10^7 n}{\cos^2\theta} \exp - [2\mu_1\rho_1(1452 - 2304 \sin^2\theta)^{\frac{1}{2}} + 2\bar{\rho}\bar{\mu}(48 \cos\theta - (1452 - 2304 \sin^2\theta)^{\frac{1}{2}})]$$

wherein: $\bar{\rho}$ is the weighted average crucible density (g/cm$^3$); $\bar{\mu}$ is the weighted average mass absorption coefficient (cm$^2$/g); I is the detected radiation intensity (number of counts per second); $\epsilon$ is the detection efficiency of said counter (decimal quotient of the number of radiation counts per second detected by said counter divided by the actual number of radiation counts per second reaching the crystal element thereof); A is the surface area of the crystal sensing element employed in said counter (cm$^2$); n is the source strength of the gamma radiation source material (Curies) and $\theta$ is the included angle defined between an imaginary leg drawn between the longitudinal axes of said radiation source and said mandrel and the leg defined by the actual path of said radiation beam.

13. The improved method of claim 11 wherein the resulting electrical signal is processed to provide visually observable data.

14. The improved method of claim 11 wherein the resulting electrical signal is processed and employed to control the rate at which said mandrel is driven upwardly.

15. The improved method of claim 11 wherein said counter includes a detection element doped with a radiation reference standard and wherein the resulting electrical signal of said counter is processed in order to gain-stabilize same.

16. The improved method of claim 11 wherein said radiation source comprise Cobalt-60.

* * * * *